United States Patent [19]

Rendell

[11] Patent Number: 4,843,959

[45] Date of Patent: Jul. 4, 1989

[54] PRODUCING PILES OF SERIALLY-INDEXED PAPERS FROM A PLURALITY OF UNINDEXED IMPRINTS

[75] Inventor: Michael R. Rendell, Dorking, England

[73] Assignee: Komori Currency Technology UK Ltd., Surrey, England

[21] Appl. No.: 174,717

[22] Filed: Mar. 29, 1988

[30] Foreign Application Priority Data

Apr. 2, 1987 [GB] United Kingdom ..... 8707858
Apr. 2, 1987 [GB] United Kingdom ..... 8707859

[51] Int. Cl.[4] ..... B41F 1/00; B07C 5/00

[52] U.S. Cl. ..... 101/301; 101/72; 101/76; 101/240; 101/484; 209/3.3; 209/9; 209/569

[58] Field of Search ..... 101/93.01, 93.07, 72–77, 101/86, 240, 21, 426, DIG. 24, 483, 484; 209/3.2, 3.3, 9, 569, 580–582, 553

[56] References Cited

U.S. PATENT DOCUMENTS 3,237,556 1/1964 Huffman .
3,988,571 10/1976 Blair et al. ..... 101/2
4,027,142 5/1977 Paup et al. ..... 101/72
4,250,806 2/1981 Boyson et al. ..... 101/86
4,677,910 7/1987 Kuhfuss ..... 101/93.07

FOREIGN PATENT DOCUMENTS 1217767 10/1964 Fed. Rep. of Germany .
1921381 4/1969 Fed. Rep. of Germany .
2522574 5/1975 Fed. Rep. of Germany .
3015103A1 4/1980 Fed. Rep. of Germany .
921064 3/1963 United Kingdom .
973227 10/1964 United Kingdom .
2034286A 10/1979 United Kingdom .

*Primary Examiner*—E. M. Eickholt
*Attorney, Agent, or Firm*—Rosen, Dainow & Jacobs

[57] ABSTRACT

Sheets or a web of bank note imprints are advanced in single file through an indexing station where a unique identifying index is applied to each imprint. The indexed imprints are stacked as a pile of strips, downstream of the indexing station, and the pile of strips cut into piles of individual indexed bank notes.

Strips containing imprints with printing blemishes or incorrect indexes are rejected before reaching the stacking station. Computer-control of the indexing units in the indexing station maintains an unbroken sequence of indexes on the imprints advanced to the stacking station despite the presence of reject strips.

22 Claims, 6 Drawing Sheets

PRODUCING PILES OF SERIALLY-INDEXED PAPERS FROM A PLURALITY OF UNINDEXED IMPRINTS

BACKGROUND OF THE INVENTION

1. Field of the Invention

This invention relates to a method of, and apparatus for, producing piles of serially-indexed security papers from a plurality of imprints on printing paper, which paper may be a continuous web or may be a plurality of discrete strips, each strip carrying a plurality of the said imprints.

2. Discussion of the Prior Art

Security papers such as bank notes, each with an individual identification index, are conventionally produced from printed sheets. Each sheet carries a matrix of unindexed security paper imprints. Successive sheets are advanced through an indexing station in which each of the imprints is given its unique index. As they emerge from the indexing station, the sheets are stacked in a pile and the pile is then cut along the rows and columns between the imprints to yield individual piles of security papers.

Each sheet may have up to, say, 8 columns and 12 rows, that is, 96 imprints. Normally each imprint carries its unique index in two positions. To index one such sheet 192 indexing operations are required.

Each index may consist of a 6-figure number and a 4-digit prefix or suffix. These indexes are applied by a letterpress printing step with the figures and digits arranged around the periphery of 10 print wheels stacked together on a common rotatory axis as a single indexing unit. In the above example, there would be 192 such units. Conventionally, the prefix or suffix is set manually, whereas the 6-figure index is given an initial setting, but thereafter advances automatically by one unit with each sheet which passes the indexing unit.

If each imprint has a unique prefix or suffix then, for a sheet with x notes on it, manual resetting is not necessary until x million notes have been indexed. If x is a large number such as 96, then the number of notes which could be printed may well be more than are required. If the requirement is for only a fraction of x million notes, then groups of indexing units can be set with the same prefix/suffix. For example, in a case where there are 8 columns of 10 imprints, a print run of 8 million notes could be conveniently achieved by assigning a different prefix/suffix to each of the 8 columns, and setting a step of 100,000 between the indexing numbers for each of the 10 imprints in each column. Problems can arise, however, when a less distinctive numbering step is indicated. Errors can easily be made during manual re-setting, resulting in the production of wrongly-indexed notes and additional security risks.

It is not unusual for the size of individual notes, and hence the number of notes on each sheet, to vary with such factors as bank note denomination. These size changes present difficulties in changing between one denomination and another, leading again to lower production rates and increased production costs.

There is always the possibility of printing blemishes on the sheets, leading to piles containing defective security papers. Various solutions to the problem of eliminating defective papers from the bundles have been proposed.

EPO No. 167196 is a proposal to detect blemished imprints on a continuous multi-column web prior to indexing, and produce at the indexing station the required unbroken sequence of indexes from the unblemished imprints. Blemished imprints are removed immediately downstream of the indexing station, after the sheets have been cut up into individual security papers, but before stacking into piles.

One problem with the proposal of EPO No. 167196 is that there is invariably a difference in the number of blemished notes in each of the columns of the web, so that the last index of the chosen index series is reached in one column of the web before it is in the remaining columns. To run off all the required index series from all the columns, a number of unindexed or cancellation-indexed imprints have to be run off in all the columns except the one which completes its print run last. These unindexed or cancelled imprints have to be removed downstream of the indexing station.

A second problem is that any malfunction of the indexing apparatus within the indexing station will produce defectively-indexed papers. For example, the ink supply to the index printer could fail, or the index-advance device could fail to operate. EPO No. 167196 lacks any proposal how to solve this problem.

A third problem is with security. Experience in the field of security printing teaches that access to the flow of security notes must be kept to a minimum to prevent unauthorised removal of imprints from the equipment. With the proposal of EPO No. 167196, a relatively large number of mechanical operations are performed downstream of the indexing station, with consequently increased likelihood that the finishing line will be accessible to unauthorised human interference, at least intermittently when the equipment needs attention. Furthermore, there are present, within the sequence of correctly-indexed notes, a relatively large number of notes not part of the unique indexing sequences destined to be checked off as part of an individual and unique packet of notes at the end of the finishing line. The need to ensure that none of these surplus notes is lost or stolen increases the costs of the process.

SUMMARY OF THE INVENTION

It is an object of the present invention to mitigate these problems.

According to a first aspect of the present invention there is provided a method of producing piles of serial-lyindexed security notes from a plurality of unindexed security note imprints on a printing paper, including the step of advancing the imprints through an indexing station at which a unique identifying index is applied to each succeeding imprint of a single file only of the imprints; and characterised by the steps of:

(a) stacking the indexed imprints as a succession of piles of unrejected strips of the printing paper, each of the piles containing a predetermined number of the strips and all of the strips of each pile carrying the same number of indexed imprints;

(b) dividing the stacks of strips into discrete piles of individual indexed imprints, that is, security notes; and further characterised in that:

(c) the step of applying the index to each imprint is so controlled that the indexes of the imprints of each of the discrete piles form a predetermined unbroken sequence from one end of the pile to the other.

According to a second aspect of the present invention there is provided apparatus for producing piles of serially-indexed security notes from a plurality of unindexed security note imprints on a printing paper, the apparatus including an indexing station at which a unique identifying index is applied to each succeeding imprint of a single file only of the imprints as the file is advanced through the indexing station; the apparatus being characterised by:

(a) means for stacking the indexed imprints as a succession of piles of unrejected strips of the printing paper, each of the piles containing a predetermined number of the strips and all of the strips of each pile carrying the same number of indexed imprints;

(b) means for dividing the stacks of strips into discrete piles of individual indexed imprints, that is, security notes;

(c) means for so controlling the application of the unique index to each imprint at the indexing station that the indexes of the imprints of each of the discrete piles form a predetermined unbroken sequence from one end of the pile to the other.

Because the method of the invention involves indexing a single column of imprints, the problem of print run completion in different columns at different times does not arise. The number of "surplus" notes downstream of the indexing station is minimized.

With full control over the index-applying equipment (in practice, computer control) a solution is possible to the problem of how to eliminate prints which are correctly printed, but nevertheless unacceptable because they are erroneously indexed. Strips carrying such prints may be removed before stacking. So, too, can strips carrying any printing blemish. Thus, the piles of correctly indexed prints would contain only acceptable notes and nothing else, and are then further processed without the inconvenience of removing any unacceptable notes.

As to the problem of security, the method of the invention permits a reduction of mechanical handling of indexed imprints to a relatively few simple operations, as is made clear below. By locating a validation print station immediately upstream of the indexing station, the security classification of the imprints upstream of the indexing station is maintained at a low level, as far as the indexing station, whereby it is only in the mechanically simple indexing and succeeding stations that the imprints have their full security value.

A further gain in mechanical reliability is achieved at the indexing station by the reduction in the number of indexing units which is a consequence of flowing through the indexing station only a single column of imprints.

The full advantages of the invention are dependent upon total control of the indexing units. As indexing method, letterpress printing seems unchallenged for the foreseeable future. Each of the above-mentioned letterpress wheels may be provided with its own individual electric stepping motor and position-sensing device. With all the stepping motors under computer control, indexing errors can instantly be rectified, and indexing units can instantly be re-set after the passage of each print run, by the appropriate indexing step. For example, an indexing step of 100 between adjacent imprints in any one strip can be adopted, and piles of one hundred notes can be collected downstream of the indexing station, so that piles of serially-indexed notes are produced ad initio, immediately downstream of the indexing station. Re-setting of the indexing units might well be necessary every time the paper for one hundred acceptable strips has passed through the indexing station. This would be totally unacceptable in apparatus where re-setting is performed manually but, under the present computer control, it represents an operation of no greater significance than the single unit numbering step which takes place after the passage of every single strip through the indexing station.

Manual re-setting is necessary only when the prefix/-suffix is due for change. This event will occur at relatively extended intervals, possibly every 8 hours or so, and this frequency of manual intervention is not objectionable..

The dividing step is potentially slower than the later steps of processing and handling the individual piles of notes. To speed up the dividing step, the flow of stacks of strips can be divided into spaced lanes (probably two lanes) for guillotining into individual piles. The stacks in the lanes can be guillotined in line abreast, or one lane at a time. Preferably, strips are engaged at the dividing station by a counting device which checks that the stack contains the correct number of strips.

For a better understanding of the invention, and to show more clearly how the same may be carried into effect, reference will now be made, by way of example to the accompanying drawings which are as identified below.

DETAILED DESCRIPTION

Figure 1:
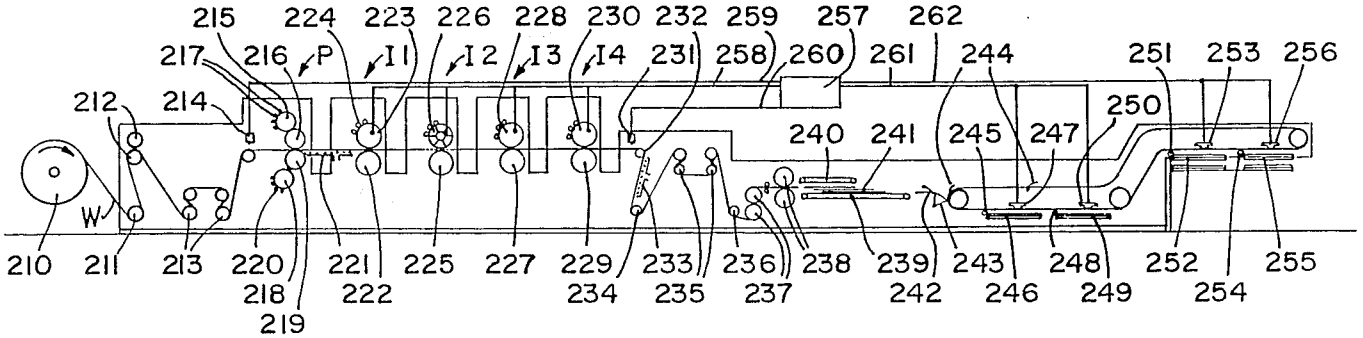
FIG. 1 is a side elevation of a web fed indexing station at the upstream end of a bank note finishing line.

Referring first to FIG. 1, a pre-printed web W of printing paper which carries a single column of security note imprints is drawn from a reel 210 over an idler roller 211, web draw rolls 212, an edge guide 213 and a web scanner 214, into an authentication unit P. The unit P has an upper plate cylinder 215 which contacts an upper blanket cylinder 216, and an inking system 217, and a lower plate cylinder 218 which contacts a lower blanket cylinder 219, and lower inking system 220. Each of the blanket cylinders 216, 219 carries on its surface a rubber sheet which receives an ink image and transfers it to the imprints on the web W. The ink image is delivered to the blanket cylinders by a printing plate carried on the respective plate cylinder. Ink is delivered to the printing plates by the respective inking systems. In this way, both sides of the web W may be printed with a validation print.

The web W, having passed between the blanket cylinders 216 and 219, is advanced over a drying unit 221 which can be, for example, an ultra-violet or infra-red drying system, with a fume extraction duct.

The web W is then advanced past, in succession, first, second, third and fourth indexing stations I1, 2, 3 and 4 respectively. The construction of each of the stations is identical.

At the first indexing station, an impression cylinder 222 has a resilient rubber facing material which presses the web W on its periphery into contact with an indexing cylinder 223 having an inking system 224, so that an imprint on the web can receive from the cylinder 223 its unique identifying index.

The second indexing station is similar, with an impression cylinder 225 and an indexing cylinder 226. Likewise, the third and fourth indexing stations have impression cylinders 227 and 229 and indexing cylinders 228 and 230 respectively.

Each indexing cylinder has accommodation for up to six indexing units arranged evenly around the circumference of the cylinder. Their construction and operation is described below with reference to FIGS. 3 to 6. Between them, the indexing units are capable of imparting two like index marks on each one of the imprints flowing past them on the web.

Downstream of the fourth indexing station is located index scanning equipment 231, which verifies the presence of each index printed on each of the imprints, and delivers this information to computer control equipment 257 along a line 260. The computer equipment 257 controls the operation of each of the indexing cylinders 223, 226, 228 and 230 through instructions lines 258.

The web W advances from the scanning equipment 231 over an idler roller 232 and past an upper drying unit 233, around an idler roller 234, edge guide system 235, idler roller 236 and web draw rolls 237 to a pair of sheeting drums 238 which co-operate to cut the web W into a succession of strips S of equal length, which strips are received from the drums 238 onto transport tapes 239 below hold-down tapes 240. The tapes 239 decelerate the strips S to provide an overlapping stream 241 of successive strips S. At the downstream end of the tapes 239, the leading edges of the successive strips S are contacted by a front register device 242 and then engaged by a swing gripper transfer device 243 which passes them to gripping devices 244 on a take-off conveyor which carries the strips S over a reject tray 246 and a re-use tray 249. Above each of these trays is a computer-controlled gripper opening cam 247, 250 respectively for selective release of individual strips S, from the gripper 244 which holds it, into one or other of the trays 246, 249. Released strips are slowed as they enter the trays by suction slow-down devices 248, 251 respectively.

In the case where one particular strip S is identified by the computer 257 as a reject strip, for example because it carries an incorrect index, the cam 247 above the reject tray 246 is actuated by the computer 257 along line 261 to cause the strip S identified as faulty to be delivered into the tray 246.

Indexed strips S not identified as faulty are carried further on by the grippers 244 and then released, by actuation of one or other of gripper opening cams 253 and 256 under the control of the computer 257 along instruction line 262, into one or other of collection trays 252 and 255 respectively. Again, at the upstream edge of each of the trays 252 and 255 there are provided suction slow down means 251, 254 respectively. Each tray has its own device (not shown) for positioning strips correctly within it, and for counting the number of strips S within it. Data from the counting means are sent back to the computer 257.

Normally, correctly indexed strips S are fed continuously to one only of the two collection trays 252 and 255, until a total of 100 correctly indexed strips S have been collected within the tray in question. Then, the computer 257 actuates the other of the two deflectors, 253 and 256 so that strips S thereafter are collected in the other of the two trays 252 and 255.

The scanner 214 scans the web W as it comes off the reel 210, and sends a signal down the line 259 to the computer 257 when it detects an imprint which includes a print blemish. Preferably, the detector is sophisticated enough to identify the blemish itself, but otherwise the detector would in fact identify a flag, manually applied earlier to each imprint on the web identified as blemished by human inspection of the imprints on the web. The computer allocates to the reject tray 246 the section of web W (i.e. the strip S) which contains the blemished imprint, and adjusts the settings at the indexing devices on the indexing cylinders 23, 26, 28, 30 to compensate for the loss of the strip.

During periods of compensation for defective strips, it may be that part of the web is advanced through the stations P and I1-4 without printing or indexing. The strips S which derive from this part of the web are consigned by the computer 257 to the re-use tray 249.

Figure 2:
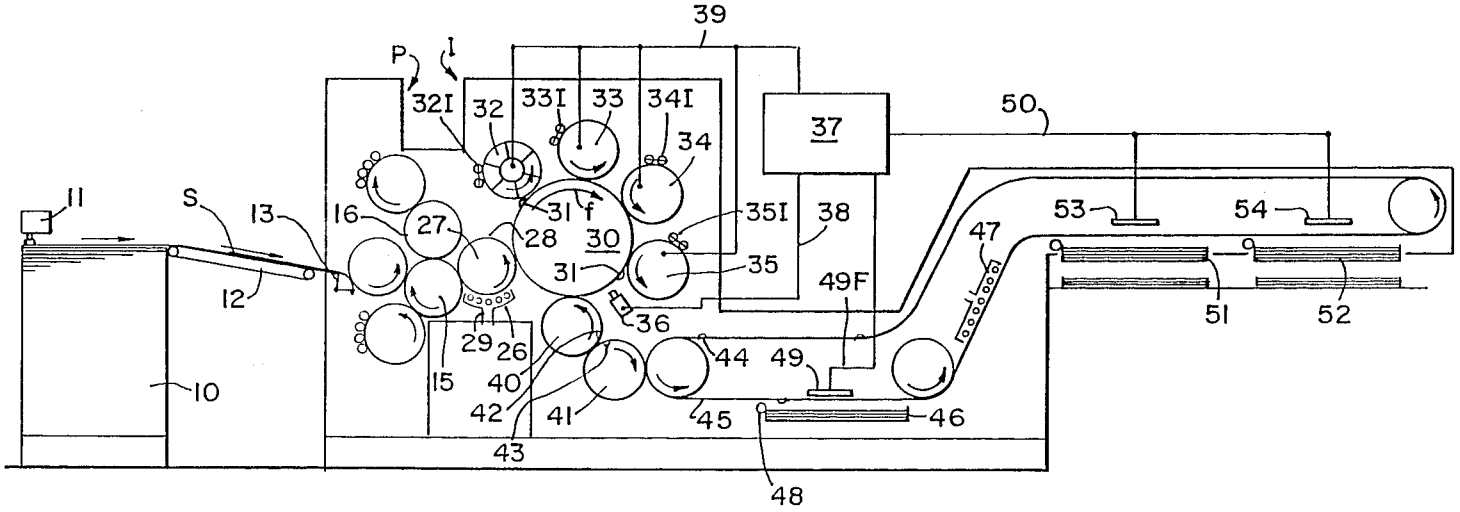
FIG. 2 is a side elevation of a sheet fed indexing station at the upstream end of a bank note finishing line.

FIG. 2 shows another embodiment, in which successive individual strips S are drawn from the top of a pile 10 of single column strips of imprints of bank notes by a separating device 11 which delivers the strips S to an infeed conveyor 12 which registers each succeeding strip S with the machine cycle of a validation print unit P, for engagement of the leading edge of each strip S with a gripping device 13 which accelerates strip S and passes it to a further leading edge gripping device 14 on a transfer cylinder and thence to a lower blanket cylinder 15 which faces an upper blanket cylinder 16. The validation unit P is otherwise constructed like the FIG. 1 unit, and operates in an analogous manner.

The strip S, having passed between the blanket cylinders 15 and 16, is carried over a drying unit 26 on the periphery of a drying cylinder 27, having its own leading edge gripping device 28. The drying unit 26 has a fume extraction duct 29.

The validation printed, dried strips S then pass onto a double-diameter impression cylinder 30, of an indexing station I, their leading edges being gripped successively, as before, by a gripping device 31. The direction of rotation of all of the cylinders is shown, as in FIG. 1, by arrows, arrow f in the case of impression cylinder 30. Cylinder 30 has two gripping devices 31, each of which carries by its leading edge one of the strips S past, in succession, a first indexing drum 32, and then second, third and fourth indexing drums 33, 34 and 35 respectively. The construction of each of the drums 32–35 is identical.

The impression cylinder 30 has a resilient rubber facing material which presses the strips S on its periphery into contact with the indexing drums, so that each imprint on each strip S can receive from one or other of the drums 32-35 its unique identifying index. The operation of the indexing drums is described below with reference to FIGS. 3 to 6.

Downstream of the last indexing drum 35 is located index reading equipment 36, which verifies the presence of the index printed on each of the imprints on the strips S, and delvers this information to computer control equipment along a line 38. The computer equipment 37 controls the operation of each of the indexing drums 32–35 through instruction lines 39.

The indexed strips S are picked off the impression cylinder 30 by the first of a pair of transfer cylinders 40 and 41, each with their own leading edge gripping device 42, 43 respectively. From the downstream transfer cylinder 41, the leading edges of the successive strips S are engaged by gripping devices 44 on a take-off conveyor 45 which carries the strips S over a reject tray 46 and then past a further drying system 47 for drying the ink of the identifying index just applied to each of the imprints on the sheet S.

In the case where one particular strip S is identified by the computer 37 as a reject strip, for example because it carries an incorrect index, a deflection device 49 above the reject tray 46 is activated by the computer 37 along line 49F to cause the strip S identified as faulty to be deflected into the tray 46.

In a more preferred embodiment there would also be a re-use tray, as in the FIG. 1 embodiment.

Indexed strips S not identified as faulty are carried past the drying unit 47 and then deflected, under the control of the computer along instruction line 50, into one or other of collection trays 51 and 52 by actuation of either deflector 53 or 54 respectively. The conveyor 45 moves at high speed and at the upstream edge of each of the trays 46, 51 and 52 there are provided means 48 for decelerating the strips S after the gripper device 44 which is holding it has released it for delivery into the respective tray.

Collected piles of 100 strips S are drawn from the trays onto a finishing line, such as is described below with reference to FIGS. 7 and 8.

Figure 3:
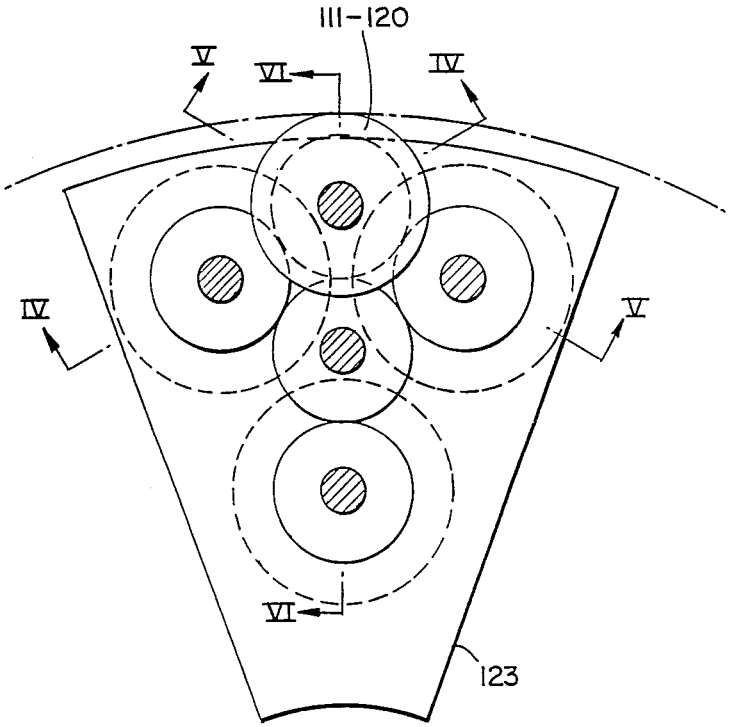
FIG. 3 is a side view of an indexing device within the indexing station.

Further details of the numbering devices 32 to 35 (which also apply to FIG. 1) are shown in FIGS. 3 to 6. Each device is based on a stack of ten printing discs 111 to 120 of which the first four, 111 to 114, carry the individual indicia of the required prefix or suffix, whereas the remaining discs 115 to 120 each carry numerals 0 to 9. The stack of these 10 discs is carried within first and second side plates 121 and 122, and each of the four numbering devices 32 to 35 carries up to six such stacks arranged in equal sectors within an arc around the circumference of the indexing drum. One such sector 123 is shown in FIG. 3.

Figure 6:
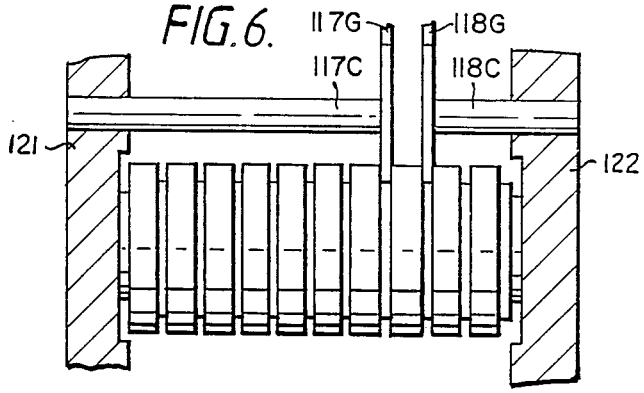

Each of the six numbering wheels 115-120 is driven by its own stepping motor. Thus disc 120 is driven by gearing 120 G on shaft 120 S of stepping motor 120 M. Each of the six stepping motors 115 M–120 M is controlled from the computer 37. FIGS. 3 and 6 show that the drive from stepping motors 117 M and 118 M passes to the respective indexing discs 117 and 118 through counter gearing on counter shafts 117 C and 118 C respectively. In this way, all six stepping motors for each of the sectors of the indexing device can be accommodated within the boundaries of the sector in question. Each of the stepping motors incorporates a position sensing device, e.g. a shaft encoder (not shown) for proper control of the operation of the motors by the computer 37. Feedback to the computer from the sensing devices enables the computer to verify the settings of the indexing units. Thus, the sensors 36, 231 check for the presence of an index, and the sensing devices on the stepper motors can verify that the index found to be present is the correct index. The strip is rejected if the index is incorrect or absent.

Generally, it will be convenient to provide for some limited circumferential movement of the side frames 121 and 122 on the indexing drum, for setting up of the equipment. The up to six stacks of indexing discs on the indexing drum 32 receive printing ink from an inking unit 32 I, and likewise there are other inking units 33 I–35 I on the drums 33 to 35. These inking systems 32 I–35 I are shown only schematically in FIG. 1. In practice, it will be convenient to include within them a means of switching on and off the flow of ink to the indexing discs, under the control of the computer 37. One way of doing this is to provide a roller that is movable under the control of the computer 37 into and out of contact with the indexing discs as they are carried past the indexing unit by rotation of the indexing drum.

In the illustrated embodiment described above, the indexing devices are computer-controlled, to the extent that any required unique 6-digit index can be provided very quickly indeed at any one of the indexing devices. It will be noted that the stepping motors which achieve this result are arranged laterally outside the stack of indexing discs. This arrangement is acceptable when the sheets being indexed consist of only one column of imprints.

To those skilled in this art, and in the art of computer control, the operation of the illustrated embodiments will be evident from what has been stated above.

When the computer 37 detects on the basis of data from the index reading device 36 that one of the sheets passing onto the transfer wheel 40 is a defective sheet, the following sequence of operations may occur:

(a) the defective sheet is channelled into tray 46;

(b) the computer 37 maintains the settings of the numbering devices on the indexing drums 32 to 35 at the settings appropriate for production of a correctly indexed sheet to replace the sheet found defective, or else resets the appropriate numbering devices to the index which should have been set earlier;

(c) as necessary, the equipment goes through one or more machine cycles under the control of the computer during which no paper is fed from the stack 10 to the validation printing station P, the indexing device being reset during this at least one cycle, but the printing press continuing to run although with the plate cylinders 17 and 19 out of the printing engagement position, the blanket cylinders spaced apart and the inking devices 18 and 20 out of their usual inking position;

(d) the indexing devices having now been re-set, and the machine cycle(s) having been completed, paper feed is recommenced;

(e) the existence of the defective sheet in the tray 46 is recorded, and the computer 37 stores for later print-out the essential details of the defective sheet.

In a web-fed embodiment, where paper feed cannot so readily be suspended, unindexed strips can be stored for re-use in the re-use tray 249.

It will be understood that in normal operation of the equipment all of the indexing devices will be manually set with the same prefix and suffix. With only one constant prefix or suffix in use during any one production run, the handling of indexed notes is greatly simplified. In practical operation, the equipment offers the real possibility of completely avoiding the need to carry stocks of print-validated notes, or even indexed notes, as work-in-progress. These stocks present a substantial security hazard, which is completely avoided in the equipment described herein, because it carries through to shrink-wrapped bundles, with the minimum of mechanical complexity and scope for human interferance, the entire output of the validation printing and indexing equipment.

It may be that the potential output of the finishing line which handles the piles of strips of indexed imprints is substantially higher than the highest output of the indexing station. In such a case it may be beneficial to arrange two (or more) single column indexing lines in parallel, their outputs feeding to a common finishing line.

In the above-described embodiment, the validation print unit P is a dry offset unit. A wet offset unit can be used instead. The validation unit can be used to provide print images on the two faces of the security papers which are in perfect registry with each other. For some users, this registry is one of the routine measures used to make counterfeiting more difficult.

Figure 4:
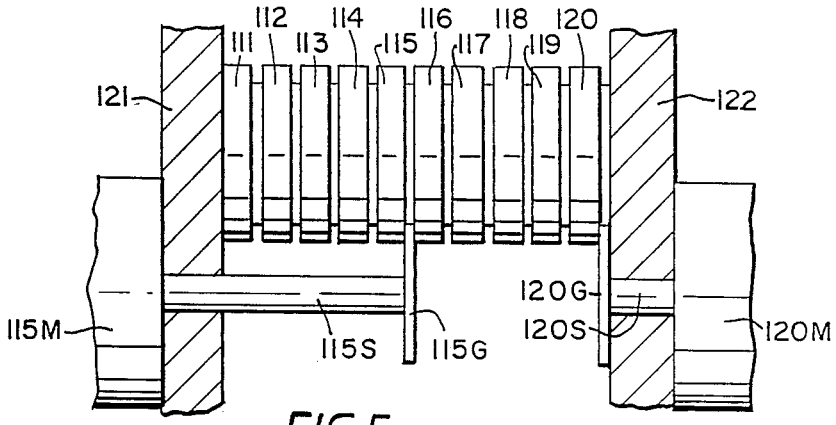
FIGS. 4, 5 and 6 are sections along the lines marked IV—IV, V—V, and VI—VI respectively in FIG. 3.
Figure 5:
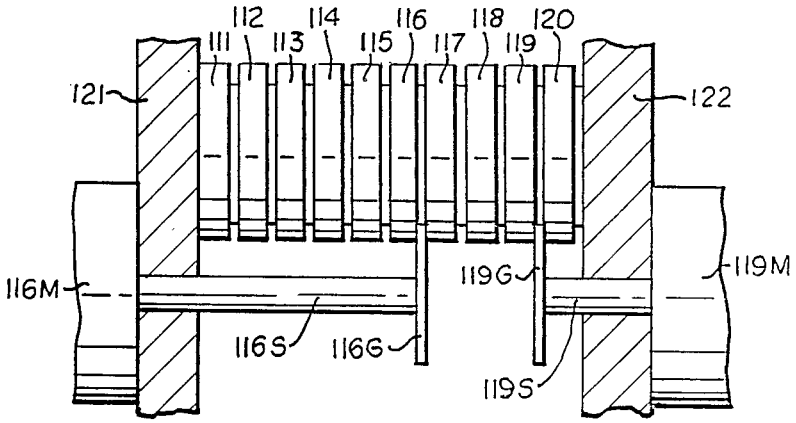

The numbering units need not take the form shown in FIGS. 3 and 4. Equipment which operates on a different principle may be used, if it attains the necessary exacting standards of print quality. Less than six motor-controlled discs could be used, and any number of manually-set discs. For example, U.S. dollar bills would have manually-set discs at both ends of a stack of discs which has the motor-controlled discs in the middle of the stack.

In other strip-fed embodiments, the double-diameter impression cylinder 30 may advantageously be replaced by a triple-diameter cylinder.

Figure 7:
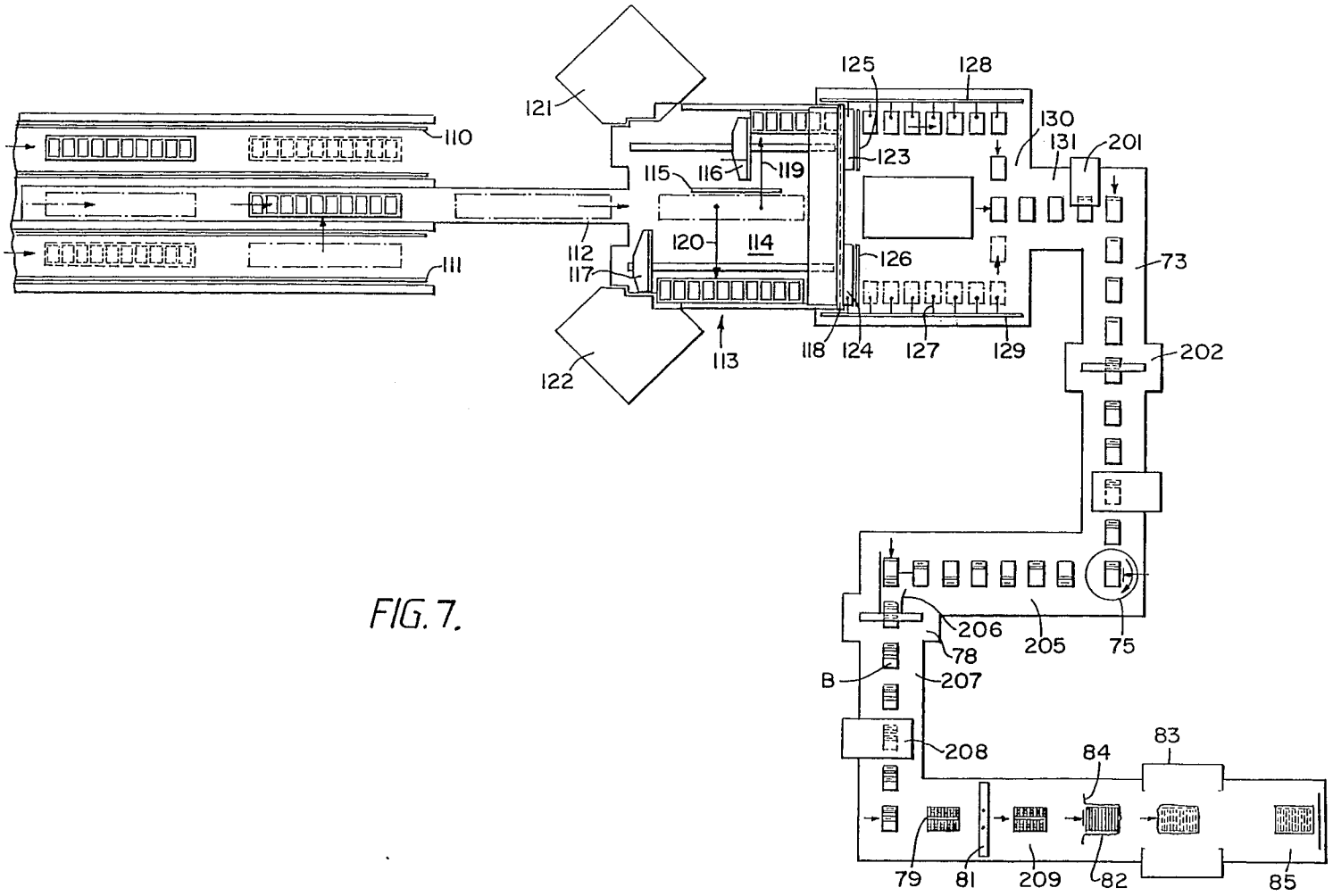
FIG. 7 is a plan view of the guillotining, banding and wrapping stations along a first embodiment of finishing line.

Reference will now be made to FIG. 7, which shows the finishing line downstream of the indexing station(s). A single line handles the output from two indexing stations as it is delivered on output conveyors 110 and 111.

An infeed conveyor 112 to the guillotining station 113 is located between the output conveyors. Transverse pushers (not shown) under the control of the indexing control computer deliver successive stacks of strips from each of the output conveyors 110 and 111 to the infeed conveyor 112. The drawing shows one possible delivery sequence, with the two stacks in full line being delivered simultaneously and then, after an interval of time for them to move downstream on the infeed conveyor, the two stacks shown in broken line are delivered simultaneously to the infeed conveyor.

The guillotining station is based on a standard guillotine. Stacks S are delivered by the conveyor 112 onto its rear bed 114 where successive stacks are moved alternatively left and right by a pusher 115. Twin pushers 116 and 117 under the control of the computer 37 advance the stacks S forward stepwise under the guillotine blade 118 along first 119 and second 120 flow paths, the blade cutting a stack of one only of the paths at any one time. While one of the stacks is being cut by the blade 118 into piles of individual notes, the pushers are moving the next succeeding stack S into position ready to be cut. First and second counting devices 121, 122 can be provided to count the number of strips in each stack during the period prior to cutting.

The strips in each stack may have a waste margin at their leading edge (especially if the strips derive from sheets of imprints rather than a web). This is removed by the blade 118 before the strips are cut into individual notes. The waste margin material can be carried away by opening (again under control of the computer 37) one of the suction ports 123 and 124.

The parted piles K of individual notes are straightened by first and second pushers 125 and 126, before being engaged by successive clamps 127 on first and second conveyors 128 and 129 which carry the piles K to a merge station 130 where transverse conveyors bring the piles K onto a single conveyor 131 which carries the piles K forward to the remaining stations of the finishing line.

After stapling (optional) at station 201, the individual packs K are delivered to the upstream end of a further conveyor 73 which carries a procession of the packs K downstream to banding station 202, and then a band overprinting station 203. The packs K are then advanced to a turntable 75 which rotates every other pack K through 180°. A pusher 204 discharges the packs K to a further conveyor 205, so that the bands on the packs K are now alternatively staggered left and right.

Groups of 10 successive packs K are delivered into a bin 206 and discharged onto a transverse conveyor 207 which delivers the group of 10 packs, as a sequentially-arranged bundle B of 10 packs K, to a bundle banding station 78 which applies a single central band 79 around the bundle. At an overprinting station 208, the central band 79 is provided with an identification code (conveniently a computer-generated set of numerals and additionally, if desired, a matching bar code). Normally these numerals will have a close correspondence with the individual identifying indexes on the notes within the bundle B (e.g. the highest and lowest indexes in the bundle B) so that, for example, random checks can be made to compare the number on the central band 79 with the numbers on the visible notes on the outside of the bundle B.

Bundles B are deflected at the downstream end of the conveyor 207 onto their side and then, on a conveyor 209, under a scanning device at a scanning station 81 which serves to count the number of packs banded within each bundle B. This is easily accomplished by utilizing the change of colour between the paper of the security notes and that of the bands encompassing them.

The conveyor 209 delivers the bundles B to a shrink-wrap station 82, followed by a shrink tunnel 83 in which hot air shrinks onto the bundle B the wrapper 84 applied to it at the wrapping station 82. The shrink-wrapped bundle is then passed to a discharge station 85 for placement into security cases, for storage or delivery as required.

Figure 8:
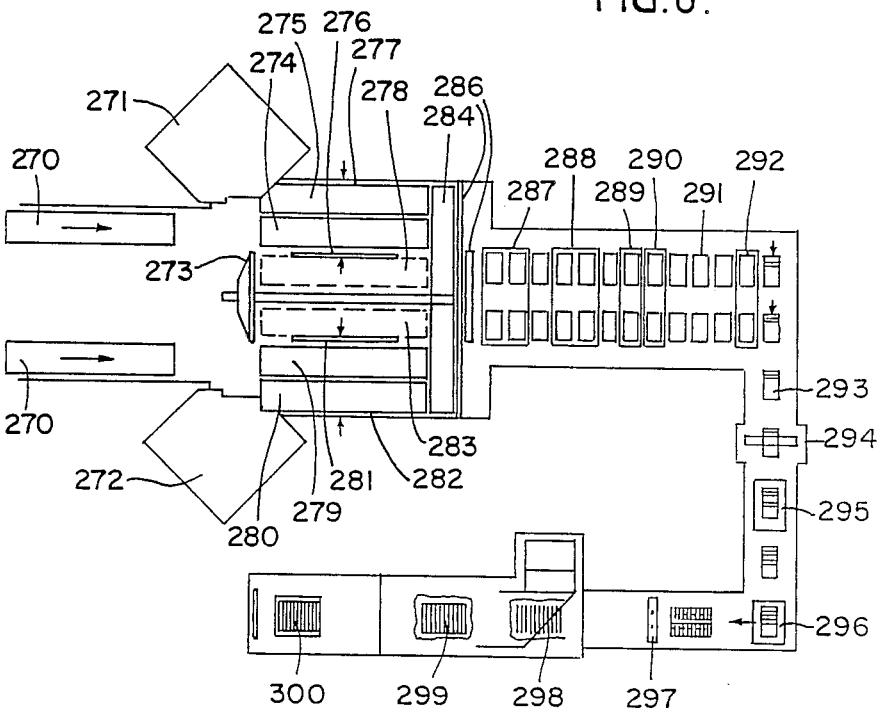
FIG. 8 is a similar view of a second embodiment of finishing line.

In the alternative embodiment of FIG. 8, stacks 270 of 100 strips arrive on two parallel conveyors in line abreast. On arrival on the guillotine bed, the left hand stack 274 is pushed by device 276 to a counting position 275 where the strips in it are counted by a counter 271. Likewise, the right hand stack 279 is pushed by 281 to a counter 272 at position 280.

After counting, left hand 277 and right hand 282 pushers move the stacks to left hand 278 and right hand 283 cutting positions from which they are simultaneously advanced step-wise under the guillotine clamp 284 and blade 285 by a common pusher 273. A slot 286 removes trim. Cut piles of notes, still in two lanes, are straightened and upturned by a jogging and turnover unit 287, and banded and upturned again at a unit 288. The bands are overprinted at a print unit 289 and stapled (if required) at staple unit 290. At 291, alternate piles are rotated 180° and at 292 packs of 5 or 10 (as required) piles are assembled. These packs are then merged at 293, banded at 294, overprinted at 295 and turned through 90° at 296. As above, they are scanned for completeness at 297, wrapped at 298, heated at 299 for shrinkage of the wrapping and delivered at 300.

It may be convenient to print the images on the web in multiple files, rather than single file only. In such a case, the multi-file web could be advanced through a succession of indexing stations, each indexing one only of the files, with the web being slitted longitudinally, downstream of the indexing stations, for stacking of single file strips. Alternatively, and preferably, a single file web could be parted from the remainder of the web, upstream of the indexing station which operates on each said single file web. For practical operation, a paper accumulator would need to be interposed between the web slitter and each indexing station. In practice, the most preferred method of working is to store each slitted single file web on its own reel, and then later feed the web to the indexing station from the reels.

I claim:

1. A method of producing piles of serially-indexed security notes from a plurality of unindexed security note imprints on a printing paper, including the step of advancing the imprints through an indexing station at which a unique identifying index is applied to each succeeding imprint of a single file only of the imprints; the method further comprising the steps of:

(a) stacking the indexed imprints as a succession of piles of unrejected strips of the printing paper, wherein each strip of the pile contains a single file only of imprints, each of the piles containing a predetermined number of the strips and all of the strips of each pile carrying the same number of indexed imprints;

(b) dividing the stacks of strips into discrete piles of individual indexed imprints constituting the security notes;

and wherein:

(c) the step of applying the index to each imprint is so controlled that the indexes of the imprints of each of the discrete piles form a predetermined unbroken sequence from one end of the pile to the other.

2. A method according to claim 1, including the steps of:

(i) examining the imprints, prior to the stacking step, for the presence of print blemishes;

(ii) rejecting, prior to the stacking step, any strip in which a detected blemish is located; and (iii) so controlling the step of applying the index that the unbroken sequence is complete within the unrejected strips.

3. A method according to claim 2, wherein the step of examining comprises;

(i) performing a manual scrutiny of the imprints;

(ii) applying a defect mark to any blemished imprint, by a manual step.

4. A method according to claim 1, including the steps of:

(i) verifying, prior to the stacking step, that the imprints on the unrejected strips are indexed in accordance with the predetermined sequence;

(ii) rejecting, prior to the stacking step, any strip not so indexed; and (iii) so controlling the step of applying the index that the unbroken sequence is complete within the unrejected strips.

5. A method according to claim 4, wherein the step of verifying comprises:

(i) examining each individual imprint downstream of the indexing station for the presence of ink in which the index is formed;

(ii) establishing what was the setting of the indexing means which was operational during the indexing of said individual imprint, and comparing the operational setting with the setting prescribed by the predetermined sequence; and (iii) rejecting any strip containing an imprint which includes a detected absence of ink or discrepancy of index from the predetermined sequence.

6. A method according to claim 1, wherein the printing paper is in the form of a web, and the method includes the further step of parting the web transversely at intervals, downstream of the indexing station, to form the strips.

7. A method according to claim 6, wherein the imprints are printed on the web in single file, so that the web only ever carries a single column of imprints.

8. A method according to claim 6, wherein the imprints are printed on the web in multiple files.

9. A method as set forth in claim 1, wherein, prior to step (a), the following steps are carried out:

forming strips containing a single file only of the imprints, examining and rejecting any strips containing a flawed imprint, and thereafter applying the said index to each imprint.

10. Apparatus for producing piles of serially-indexed security notes from a plurality of unindexed security note imprints on a printing paper, the apparatus including an indexing station at which a unique identifying index is applied to each succeeding imprint of a single file only of the imprints as the file is advanced through the indexing station; the apparatus including:

(a) means for stacking the indexed imprints as a succession of piles of unrejected strips of the printing paper, wherein each strip of the pile contains a single file only of imprints, each of the piles containing a predetermined number of the strips and all of the strips of each pile carrying the same number of indexed imprints;

(b) means for dividing the stacks of strips into discrete piles of individual indexed imprints constituting the security notes; and (c) means for so controlling the application of the unique index to each imprint at the indexing station that the indexes of the imprints of each of the discrete piles form a predetermined unbroken sequence from one end of the pile to the other.

11. Apparatus as claimed in claim 10, including means for examining the imprints, prior to their stacking, for the presence of print blemishes, means for rejecting, prior to stacking, any strip in which a detected blemish is located; and wherein the means for controlling the application of the unique index maintains the unbroken sequence complete within the unrejected strips.

12. Apparatus as claimed in claim 11, wherein the examining means comprises means enabling the application of a defect mark to any blemished imprint, by a manual step.

13. Apparatus as claimed in claim 10, including means for verifying, prior to stacking, that the imprints on the unrejected strips are indexed in accordance with the predetermined sequence, means for rejecting, prior to stacking, any strip not so indexed, and wherein the means for controlling the application of the unique index maintains the unbroken sequence complete within the unrejected strips.

14. Apparatus as claimed in claim 13, wherein the verifying means comprises:

(i) means for examining each individual imprint downstream of the indexing station for the presence of ink in which the index is formed;

(ii) means for establishing what was the setting of the indexing means which was operational during the indexing of said individual imprint, and comparing the operational setting with the setting prescribed by the predetermined sequence; and (iii) means for rejecting any strip containing an imprint which includes a detected absence of ink or discrepancy of index from the predetermined sequence.

15. Apparatus as claimed in claim 10 wherein the apparatus includes means for feeding discrete strips of said imprinted paper to the indexing station.

16. Apparatus as claimed in claim 15, wherein the indexing unit comprises a plurality of indexing units on the periphery of a common impression cylinder.

17. Apparatus as claimed in claim 10, wherein the apparatus includes means for feeding a continuous web of said imprinted printing paper to the indexing station.

18. Apparatus as claimed in claim 17, wherein the indexing station comprises a plurality of indexing units located sequentially downstream of each other, and each with its own separate impression cylinder.

19. A method of producing piles of serially-indexed security notes from a plurality of unindexed security note imprints on a printing paper, including the step of advancing the imprints through an indexing station at which a unique identifying index is applied to each succeeding imprint of a single file only of the imprints; the method further comprising the steps of:

(a) stacking the indexed imprints as a succession of piles of unrejected single file strips of the printing paper, each of the piles containing a predetermined number of strips and all of the strips of each pile carrying the same number of indexed imprints;

(b) dividing the stacks of strips into discrete piles of individual indexed imprints constituting the security notes by:

(i) defining spaced lanes for advancement of the stacks past a dividing means;

(ii) dividing the flow of the successive stacks of strips between the spaced lanes;

(iii) advancing the stacks in the spaced lanes past the dividing means; and (iv) downstream of the dividing means, combining the flow of piles of security prints in each of the spaced lanes into a single lane for further processing of the piles;

and wherein:

(c) the step of applying the index to each imprint is so controlled that the indexes of the imprints of each of the discrete piles form a predetermined unbroken sequence from one end of the pile to the other.

20. A method according to claim 19, wherein a stack in one only of the spaced paths is advanced past the dividing means at any particular time.

21. A method according to claim 19, wherein a stack in each of the spaced paths is advanced the dividing means at the same time in line abreast.

22. Apparatus for producing piles of serially-indexed security notes from a plurality of unindexed security note imprints on a printing paper, the apparatus including at least two indexing stations in parallel at each of which a unique identifying index is applied to each succeeding imprint of a single file only of the imprints as the file is advanced through the indexing station; the apparatus further including:

(a) means for stacking the indexed imprints as a succession of piles of unrejected strips of the printing paper, each of the piles containing a predetermined number of steps and all of the strips of each pile carrying the same number of indexed imprints;

(b) means for dividing the stacks of steps into discrete piles of individual indexed imprints constituting the security notes, said dividing means comprising a single dividing means to receive the combined outputs of the indexing stations; and (c) means for so controlling the application of the unique index to each imprint at each indexing station that the indexes of the imprints of each of the discrete piles form a predetermined unbroken sequence from one end of the pile to the other.

* * * * *